US012486678B2

(12) United States Patent
Taylor

(10) Patent No.: US 12,486,678 B2
(45) Date of Patent: Dec. 2, 2025

(54) CONSTRUCTION DEVICES FOR ROOFING

(71) Applicant: Bobby R Taylor, Pocahontas, TN (US)

(72) Inventor: Bobby R Taylor, Pocahontas, TN (US)

( * ) Notice: Subject to any disclaimer, the term of this patent is extended or adjusted under 35 U.S.C. 154(b) by 558 days.

(21) Appl. No.: 17/081,402

(22) Filed: Oct. 27, 2020

(65) Prior Publication Data

US 2022/0127865 A1 Apr. 28, 2022

(51) Int. Cl.

| | |
|---|---|
| ***E04G 3/26*** | (2006.01) |
| ***E04G 3/22*** | (2006.01) |
| ***E04G 5/04*** | (2006.01) |
| ***E04G 5/06*** | (2006.01) |

(52) U.S. Cl.

CPC ..... *E04G 3/22* (2013.01); *E04G 3/26* (2013.01); *E04G 5/041* (2013.01); *E04G 5/065* (2013.01)

(58) Field of Classification Search

CPC ..... E04G 3/22; E04G 5/041; E04G 21/3214; E06C 1/345; E04B 2002/7485; E04C 2003/026

See application file for complete search history.

(56) References Cited

U.S. PATENT DOCUMENTS 1,569,951 A * 1/1926 Cooper ..... E04G 21/3285 248/237
2,204,566 A * 6/1940 Buelow ..... E04C 3/02 52/695
3,010,162 A * 11/1961 Klein ..... E04C 3/02 52/696
3,880,405 A * 4/1975 Brueske ..... E04G 21/3285 248/237
5,152,107 A * 10/1992 Strickert ..... E04D 13/10 52/24
5,228,248 A * 7/1993 Haddock ..... E04D 13/103 52/25
5,491,931 A * 2/1996 Haddock ..... E04D 13/103 52/25
5,613,328 A * 3/1997 Alley ..... E04D 13/10 52/24
5,694,721 A * 12/1997 Haddock ..... E04G 21/3261 52/745.1
5,732,918 A * 3/1998 Steele ..... E04G 3/26 248/300
5,870,874 A * 2/1999 Brothers ..... E04C 3/02 52/696

(Continued)

*Primary Examiner* — Jessica L Laux
*Assistant Examiner* — Kathleen M. McFarland
(74) *Attorney, Agent, or Firm* — HULSEY P.C.

(57) ABSTRACT

A device for use in securing a ladder to a roof for use in attaching roofing panels to the roof or for inspecting panels. The device includes a main body portion having a bottom floor having a plurality of corrugation openings formed therethrough, the corrugation openings sized and configured to straddle corrugations of roofing panels while allowing the bottom floor to lie substantially flat on the panel. A plurality of fastener openings are functionally associated with the bottom floor for use in selectively securing and detaching the main body portion to the roof using roofing fasteners. In embodiments attachment member chambers contain attachment members slidably disposed therein for use in attaching the device to a roof. Methods of using the devices for installing roofing panels and inspecting panel roofs are included.

19 Claims, 10 Drawing Sheets

(56) References Cited

U.S. PATENT DOCUMENTS 6,164,033 A * 12/2000 Haddock ..... E04D 13/10 52/24
6,216,416 B1 * 4/2001 West ..... E04G 3/26 52/749.12
6,332,299 B1 * 12/2001 Stewart, III ..... E04C 3/292 52/696
6,418,695 B1 * 7/2002 Daudet ..... E04B 7/022 52/696
6,688,047 B1 * 2/2004 McNichol ..... E04D 13/10 52/25
7,513,080 B1 * 4/2009 Showalter ..... E04D 13/10 52/24
8,025,126 B1 * 9/2011 Lefavor ..... E04G 21/3261 248/237
8,424,821 B2 * 4/2013 Liu ..... F24S 25/615 248/237
8,769,911 B2 * 7/2014 Montgomery ..... E04B 1/54 52/705
8,844,234 B2 * 9/2014 Haddock ..... F16B 5/0096 52/545
9,022,172 B2 * 5/2015 McCarthy ..... E06C 1/345 182/129
9,187,914 B2 * 11/2015 Lallier ..... E04G 21/3285
9,353,527 B2 * 5/2016 Smeja ..... F24S 25/615
9,404,257 B2 * 8/2016 Reno ..... E04G 21/1891
9,458,639 B1 * 10/2016 Coleman ..... E04G 21/3214
9,493,955 B1 * 11/2016 Christian ..... E04D 13/10
9,593,497 B2 * 3/2017 Tulpa ..... B32B 3/085
9,816,279 B2 * 11/2017 Bond ..... E04G 3/26
9,834,937 B2 * 12/2017 Warner ..... B32B 7/04
10,385,573 B2 * 8/2019 Van Leuven ..... E01H 5/102
D866,299 S * 11/2019 Kovacs ..... D8/354
10,487,511 B2 * 11/2019 Lallier ..... E04G 21/3214
10,840,851 B2 * 11/2020 Schaefer ..... F24S 10/00
11,213,704 B2 * 1/2022 Smith ..... A62B 35/0068
11,549,274 B2 * 1/2023 Black ..... E04G 5/041
2005/0196258 A1 * 9/2005 Stabs ..... B60R 11/00 414/462
2010/0251660 A1 * 10/2010 McCann ..... E04C 3/17 52/677
2014/0209411 A1 * 7/2014 McCarthy ..... E06C 7/16 182/129
2015/0060620 A1 * 3/2015 Smeja ..... E04D 13/10 248/237
2016/0123025 A1 * 5/2016 Tulpa ..... B32B 25/16 428/141
2017/0159295 A1 * 6/2017 Warner ..... B32B 7/12
2017/0229852 A1 * 8/2017 Jones ..... E04C 3/32
2018/0328054 A1 * 11/2018 Black ..... E04G 21/3204
2019/0078339 A1 * 3/2019 Robinson ..... E04G 23/0281
2019/0234076 A1 * 8/2019 Lallier ..... E04D 13/12
2019/0366134 A1 * 12/2019 Smith ..... E04G 21/3285
2022/0056716 A1 * 2/2022 Nichols ..... E04G 21/3285

* cited by examiner

CONSTRUCTION DEVICES FOR ROOFING

CROSS REFERENCE TO RELATED APPLICATIONS

Not applicable

FIELD OF THE INVENTION

The present invention relates to construction devices and methods, and more particularly to devices and methods for securely and efficiently temporarily securing ladders on roofs during roofing operations, including construction of and inspection of roofs.

BACKGROUND OF THE INVENTION

Metal roofing is preferred in many situations due to the high resistance, impermeability and longevity of metal roofs. Because of longevity, in the long term, metal roofs are less expensive than conventional asphalt shingles. Additionally, the reflective properties of metal roofs can reduce energy usage. Metal roofs are also lightweight, which creates less stress on the building structure. As indicated in FIG. 1, metal roofing is applied to roofs in the form of interlocking panels of corrugated metal panels or sheets. The roofing panels can be of various dimensions, such as 8 to 12 feet long by 24 to 36 inches wide. Each panel has a plurality of lengthwise ridges extending along the length of the panel. The ridges conventionally have a standard height and spacing, which differs between residential and commercial versions. The ridges strengthen the panels and facilitate the interlocking of adjacent panels in a secure, watertight figuration. However, the ridges make it difficult for roofers to work on the panels during panel installation. The ridges also make it difficult to inspect roofs during inspections.

Installation of metal roofing can be a dangerous operation. Risk are magnified in dangerous conditions, such as in the presence of wind, rainwater, condensation or residual ice.

When installing corrugated metal roofing, OSHA requires that ladders be tied down. Current safety devices and techniques slow down the roofing operation and can damage the roofing panels during installation. Current technology does not work well on steep roofs and in difficult locations.

There is thus a need for devices and methods for securing ladders during roofing operations having the following characteristics.

OBJECTS AND SUMMARY OF THE INVENTION

It is an object of the inventions to provide devices and methods for reducing the risk of injury during roofing operations.

It is an object of the inventions to provide devices and methods for efficiently securing ladders during roofing operations.

Another object of the inventions to provide toe board devices that are easy to use for securing ladders during roofing operations.

Yet another object of the inventions is to provide toe board devices that are durable, reusable, and easy to move between roofing jobs.

The foregoing and other objectives and advantages are achieved by providing total boards having the features described herein.

In embodiments, the invention is generally a device for use in securing a ladder to a roof for use in attaching roofing panels to the roof or for inspecting panels, the panels having a planar surface interspersed with a plurality of corrugations. In embodiments, the device comprises, generally, a main body portion, the main body portion having a lengthwise dimension, a bottom floor, a top side, and a front wall, the front wall extending between the bottom floor and top side and configured to support a base of said ladder; the bottom floor having a plurality of corrugation openings formed therethrough, the corrugation openings sized and configured to straddle said corrugations of said panel while allowing the planar bottom floor to lie substantially flat on said panel; and a plurality of fastener openings functionally associated with the bottom floor for use in selectively securing and detaching the main body portion to said roof using roofing fasteners, each of the fastener openings having a larger portion for receiving a head of a fastener therethrough and a slot portion for retaining a head of a fastener. The top side has a plurality of attachment openings therethrough, each of the attachment openings providing access to the fastener openings for use in selectively attaching the main body portion to said roof with fasteners and for selectively detaching the main body portion from the roof by disengaging fasteners.

In embodiments, the device includes a plurality of attachment member chambers formed in the main body portion, the attachment member chambers positioned for removably securing the attachment members to said planar surface of said panel when the corrugation openings straddle said corrugations of said panel. Each of the attachment member chambers can contain an attachment member slidably disposed within the attachment member chamber. Each of the attachment members can have a bottom base portion, the bottom base portion including a portion of the plurality of fastener openings formed therethrough. Each of the attachment openings is associated with one of the attachment member chambers to thereby provide access to the attachment members.

In embodiments, the device includes a front top rail and an opposing back top rail each extending into the attachment openings along the top side, and a front bottom rail and an opposing back bottom rail each extending into the main body portion along the bottom floor. The rails together are configured to assist in retaining the attachment members in a sliding relationship inside of the main body portion.

In embodiments, the bottom base portion of each of the attachment members includes at least six of the plurality of faster openings. In embodiments, the main body portion is a unibody structure. The main body portion can be configured as a lengthwise box.

In embodiments, a plurality of tie members extend from the main body portion for use in tying said ladder to the main body portion.

In embodiments, the device is sized and configured for use with standard residential panels. In residential embodiments, the main body portion can be about 33 inches long and has three corrugation openings. The corrugation openings are about 2 inches wide and about 1.25 inches tall to thereby provide sufficient clearance for corrugations of standard residential metal panels. The corrugation openings are centered about 7.5 inches apart.

In embodiments, the device is sized and configured for use with standard commercial panels. In commercial embodiments, the main body portion can be about 34 inches long and has two corrugation openings. The corrugation openings are about 3 inches wide and about 1.75 inches tall to thereby provide sufficient clearance for corrugations of standard commercial panels. The corrugation openings are centered about 12 inches apart to thereby allow the device to straddle corrugations of standard commercial metal panels.

In embodiments, the plurality of fasteners functionally associated with the bottom floor are formed through the bottom floor. The plurality of fastener openings can include at least six faster openings positioned between each of said corrugation openings.

Methods of using the foregoing devices for installing roofing panels and inspecting panel roofs are included in the invention.

The foregoing and other objects, features, aspects and advantages of the invention will become more apparent from the following detailed description of the invention when considered in conjunction with the accompanying drawings.

PREFERRED EMBODIMENTS OF THE INVENTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
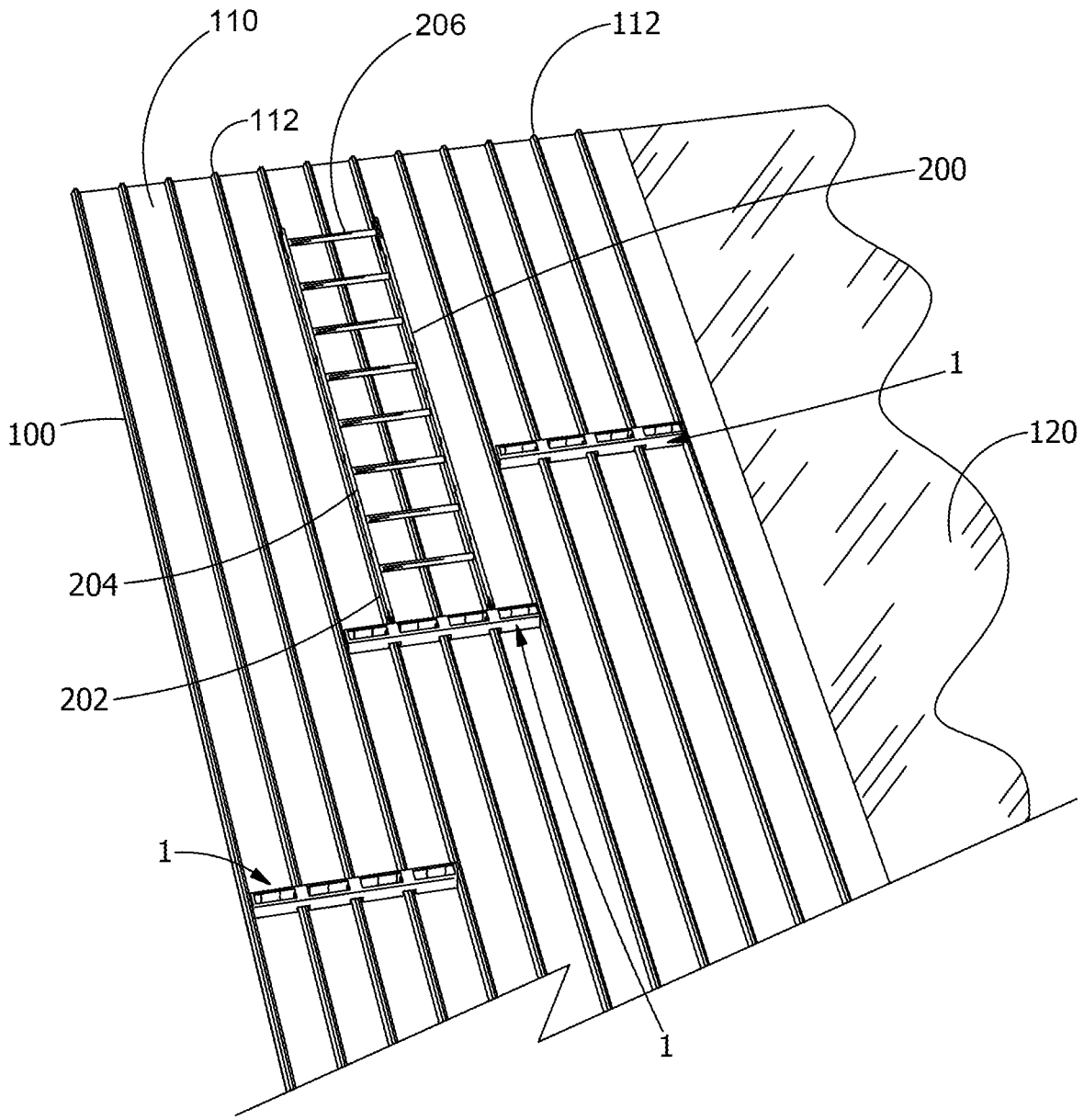
FIG. 1 is an operational view of one embodiment of a toe board of the invention, featuring use of a plurality of toe boards on a roof.

The invention comprises, generally, toe boards 1 that secure ladders to roofs during roofing operations. Roofing operations can include construction/paneling of roofs as well as inspections of roofs. As indicted in FIG. 1, the toe boards 1 of the invention are adapted particularly for use on corrugated metal roofs that are shingled/covered with metal panels or sheets. The toe board 1 devices are readily attachable to and detachable from roofs during roofing operations. FIG. 1 shows the use of a plurality of toe boards 1 on a roof 100. The roof 100 shown in FIG. 1 includes a portion that has been covered with metal panels 110, as well as an un-shingled portion 120. The roofer places each toe board 1 in a selected position over the metal panels 110. The toe board 1 is configured to straddle the corrugations 112 on the metal panels 110 such that the bottom base of the toe board 1 rests essentially flat on the surface of the roof 100. Each toe board 1 is removably secured to the roof 100 in a manner described below. With the toe board 1 secured to the roof 100, a ladder 200 can be safely placed on the top of the toe board 1. The base 202 of each leg 204 of the ladder 200 rests on the top of the toe board 1. The ladder 200 lies along the slope of the roof 100, such that the roofer can move up and down the ladder 200 using the rungs 206 of the ladder for support. Details about the toe boards 1 and methods of using such toe boards 1 will be described in further detail below.

Figure 2A:
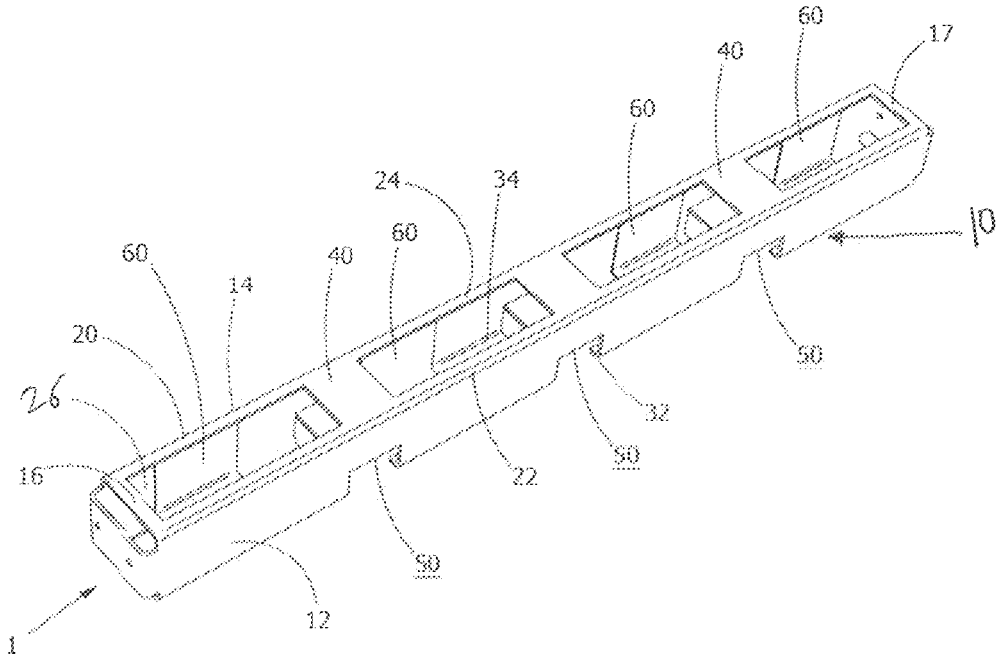
FIG. 2A is a top perspective view of one embodiment of a toe board of the invention.

FIG. 2A is a top perspective view of one embodiment of a toe board 1 of the invention. In the embodiment of FIG. 2A, the toe board 1 includes a body 10 comprising a generally lengthwise box-like structure. Other geometric configurations can be used provided that they carry out the objectives described herein. The body 10 includes a front or ladder wall 12, a backwall 14, an opposing first end wall 16, an opposing second end wall 17, a top or sky side 20, and a bottom floor 30. In the illustrated embodiment, the front/ladder wall 12 and the backwall 14 are symmetrical, such that either can serve to support a ladder 200 on a roof 100. The toe board 1 can be designed such that only one side can be used to support a ladder 200 on a roof. For structural purposes, the body 10 is preferably a unibody structure, such as by welding individual components together. In the illustrated embodiment, the components of the body 10 are made of steel or aluminum, but other metals or other durable materials could be used provided that they are strong enough to securely support a ladder and a roofer in the manner described herein.

Figure 2B:
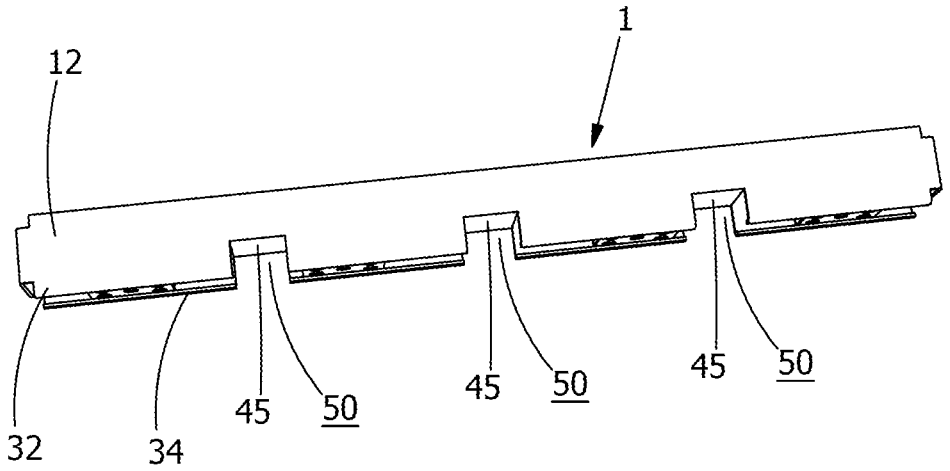
FIG. 2B is a side perspective view of one embodiment of a toe board of the invention.
Figure 2C:
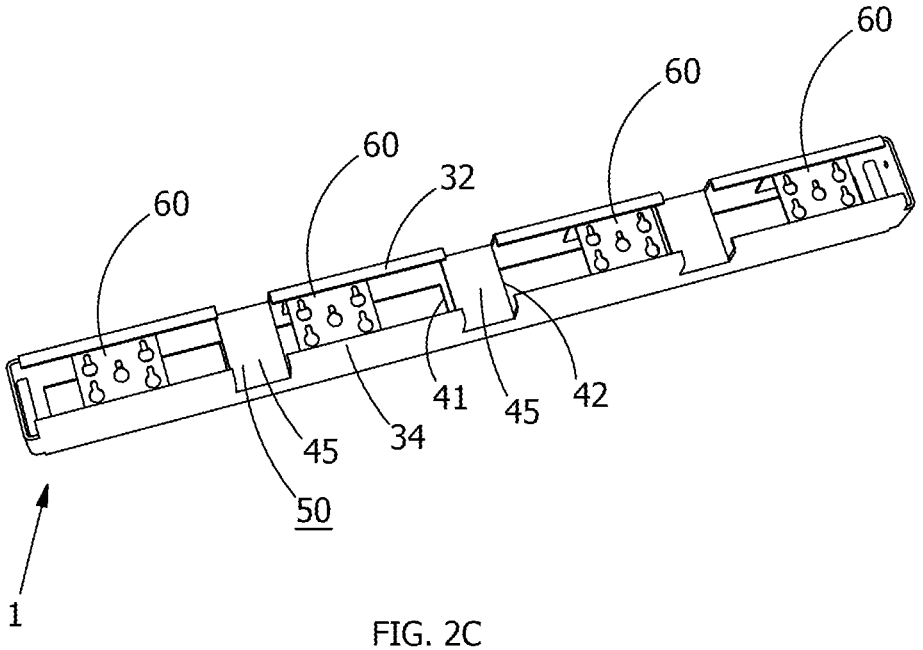
FIG. 2C is a bottom perspective view of one embodiment of a toe board of the invention.
Figure 2D:
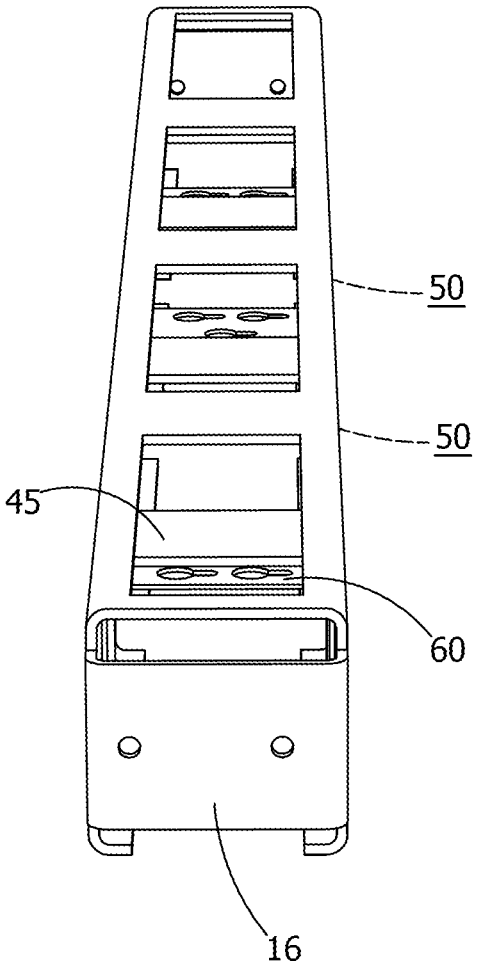
FIG. 2D is a end perspective view of one embodiment of a toe board of the invention.

A plurality of attachment member openings 26 are formed through the top 20 of the toe board 1. Typically, four attachment member openings 26 are provided for residential toe boards 1 and three attachment member openings 26 are provided for commercial toe boards. As shown in FIGS. 2A-2C, a plurality of corrugation openings 50 are formed along the bottom floor 30. Typically, three corrugation openings 50 are provided for residential panel toe boards 1 and two corrugation openings 50 are provided for commercial panel toe boards 1. In the embodiment of FIG. 2A, an attachment member 60 is slidably positioned in an interior chamber associated with each of the attachment member openings 26. As shown in FIG. 2C, each of the attachment members 60 has a plurality of fastener openings 70, which are discussed in further detail below. In the embodiment of FIGS. 2A-2C, each attachment member opening 26 is bordered by a front top rail 22, a back top rail 24, a front bottom rail 32, and a back bottom rail 34. The rails 22, 24, 32, 34 overhang or extend into the attachment member opening and are configured to retain the attachment members 60 in the body 10, such that the attachment member 60 can be selectively slide lengthwise within the body 10 of the toe board 1. This feature allows the attachment members 60 to be selectively positioned between adjacent corrugations 112 for use in securing the toeboard 1 to the roof 100.

Between each attachment member opening 26, a plurality of top cross bars 40 span the top 20 between the front rails 22, 24. The cross bars 40 provide structural support for the body 10. Additionally, each of the cross bars 40 serves as a stop to assist in retaining an associated attachment member 60 within its respective attachment member opening 26. As shown in the bottom view of FIG. 2C, each cross bar 40 includes first and second downwardly depending walls 41, 42. For structural reasons, each cross bar 40 can also include a bottom wall 45. As indicated in the bottom view of FIG. 2C, each attachment member 60 can only slide the length of its respective opening 26 because the extent of lateral motion is restricted by adjacent downwardly depending walls 41, 42 of adjacent cross bars 40. In the case of the outer attachment members 60, restriction is also provided by the interior side of the first and second end walls 16, 17, respectively. However, the attachment members 60 can be slid along the length of the associated attachment member opening 26 without restriction, thus allowing for a wide range of selected positions for each attachment member 60. This characteristic makes it easy and quick to position an attachment member 60 and secure it with roofing screws or other fasteners.

As shown in FIGS. 2B-2C, the corrugation slots 50 extend across the bottom floor 30 of the body 10 between the front wall 12 and the backwall 14. The corrugation slots 50 are sized and configured to straddle the corrugations 112 of standard metal roofing panels 110. Exemplary dimensions are discussed below.

Figure 5A:
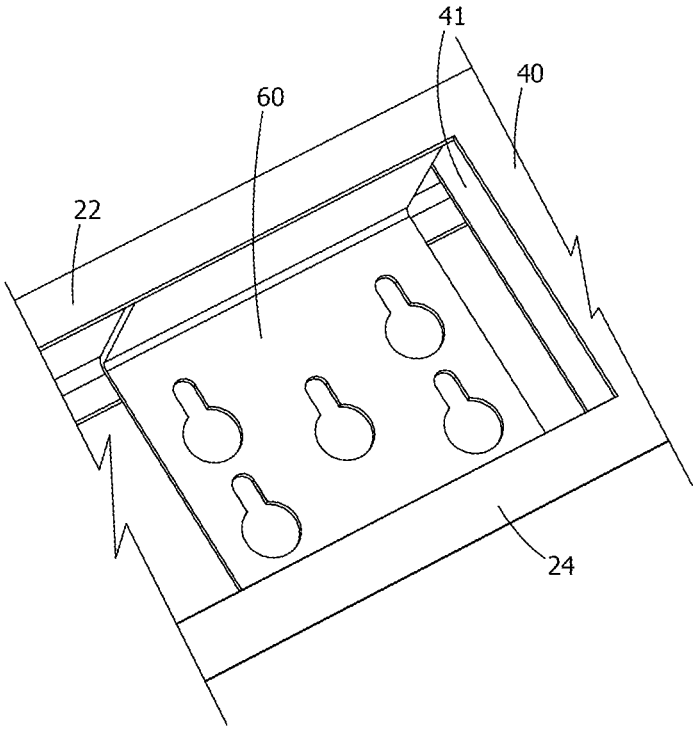
FIG. 5A is a top perspective view of one embodiment of an attachment member in a toe board of the invention.
Figure 5B:
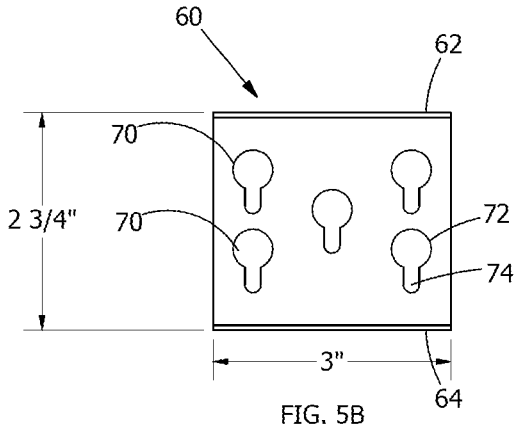
FIG. 5B is a top dimensional view of one embodiment of an attachment member for a toe board of the invention.
Figure 5C:
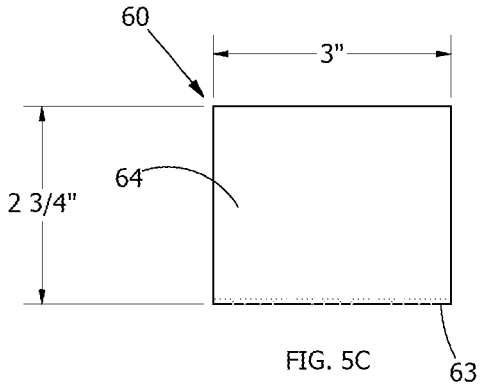
FIG. 5C is a front-side dimensional view of one embodiment of an attachment member for a toe board of the invention.
Figure 5D:
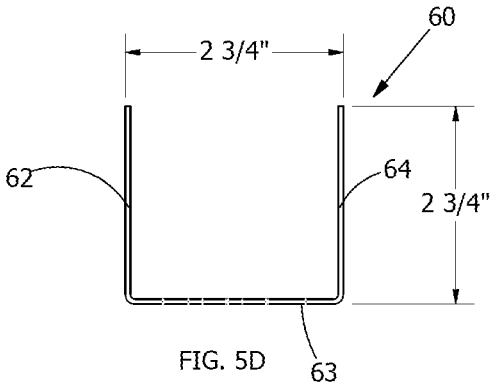
FIG. 5D is an end-side dimensional view of one embodiment of a toe board of the invention.

FIGS. 5A-5D show details of one embodiment of the attachment members 60. As shown in FIG. 5D, the attachment member 60 is a generally U-shaped unibody structure when viewed from the side. The attachment member 60 has a front sidewall 62 and an opposing back sidewall 64. The walls 62, 64 are joined by a bottom base member 63. The walls 62, 64 and the bottom base member 63 are substantially planar. The walls 62, 64 are sized to closely fit the height of the front and back walls 12, 14 of the toe board 1 so as to minimize vertical play of the attachment members 60 within the toe board 1.

As shown in FIGS. 5A-5B, the bottom base member 63 of the attachment member 60 has a plurality of fastener openings 70 formed therethrough. In the pictured embodiment, five fastener openings 70 are provided. The fastener openings are spaced to provide options for removably securing the attachment member 60 to a roof 100. Each fastener opening 70 includes a large portion 72 and a contiguous slot portion 74. The large portion 72 is sized to allow the head of a screw to pass through the large portion 72, while the slot portion 74 is sized to retain the head of nails or screws. The sizing of the fastener openings 70 can vary but will generally be sized to work with commonly available roofing nails, since one purpose of the invention is to provide a simple and economical method of selectively fastening the toe board 1 to roofs.

Figure 3A:
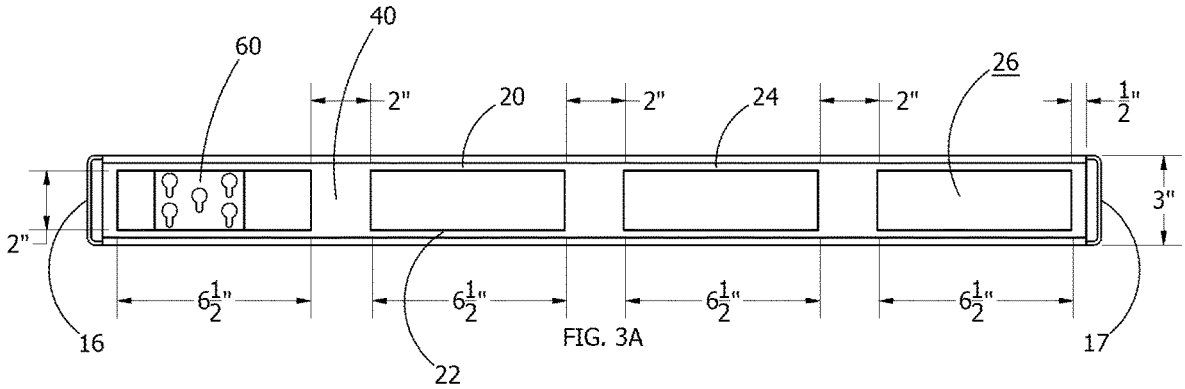
FIG. 3A is a top dimensional view showing dimensions of one embodiment of a toe board of the invention for use on residential roofing.

Exemplary dimensions of residential panel toe boards 1 will now be discussed. FIG. 3A is a top dimensional view showing dimensions of one embodiment of a toe board of the invention for use on residential roofing. The toe board 1 is about 33 inches long, about 3 inches wide, and about 3 inches tall. The crossbars 40 are each about 2 inches wide. The attachment member openings 26 are each about 6.5 inches long and about 2 inches wide. The top rails along the first and second end walls 16, 17 are about 0.5 inches wide. As seen in the front side view of FIG. 3B, the corrugation openings 50 are about 2 inches wide and about 1.25 inches tall, which provides sufficient clearance for the corrugations 112 of standard residential metal panels.

Figure 3B:
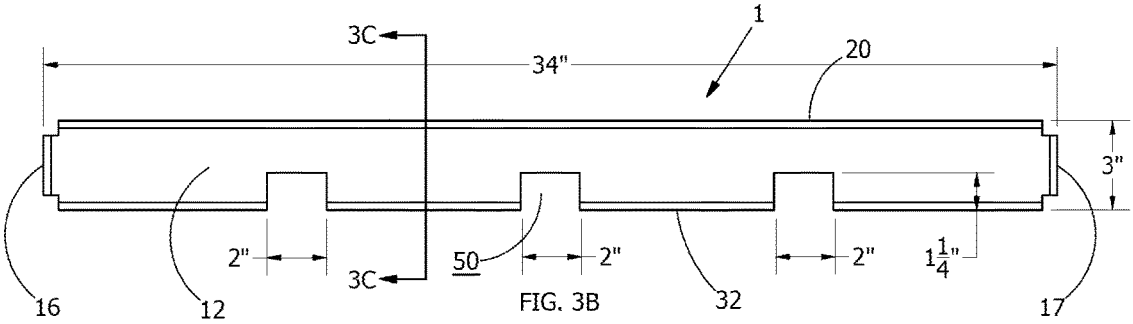
FIG. 3B is a front side dimensional view showing dimensions of one embodiment of a toe board of the invention for use on residential roofing.
Figure 3C:
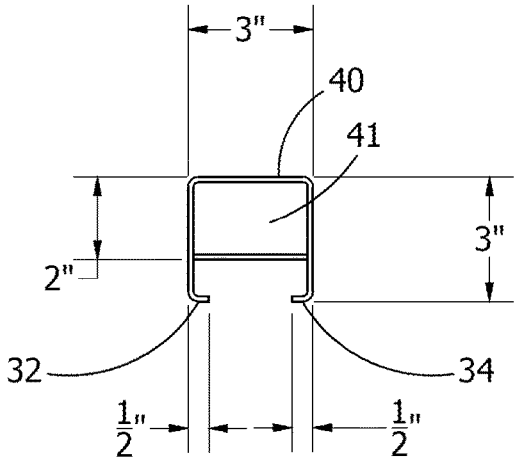
FIG. 3C is a side dimensional view showing dimensions of one embodiment of a toe board of the invention for use on residential roofing.

The cross section view of FIG. 3C, which is taken along 3*c*-3*c* of FIG. 3B, shows details of the crossbars 40. The crossbar 40 is about 3 inches long across the top 20 of the toe board 1. The interior sidewalls 41, 42 are about 2 inches tall, thus leaving about 1 inch of clearance below the crossbar 40. The front bottom rail 32 and back bottom rail 34 each extend about 0.5 inches into the body of the toe board 1 to assist in retaining the attachment members 60 in a sliding relationship inside of the toe board 1.

Figure 4:
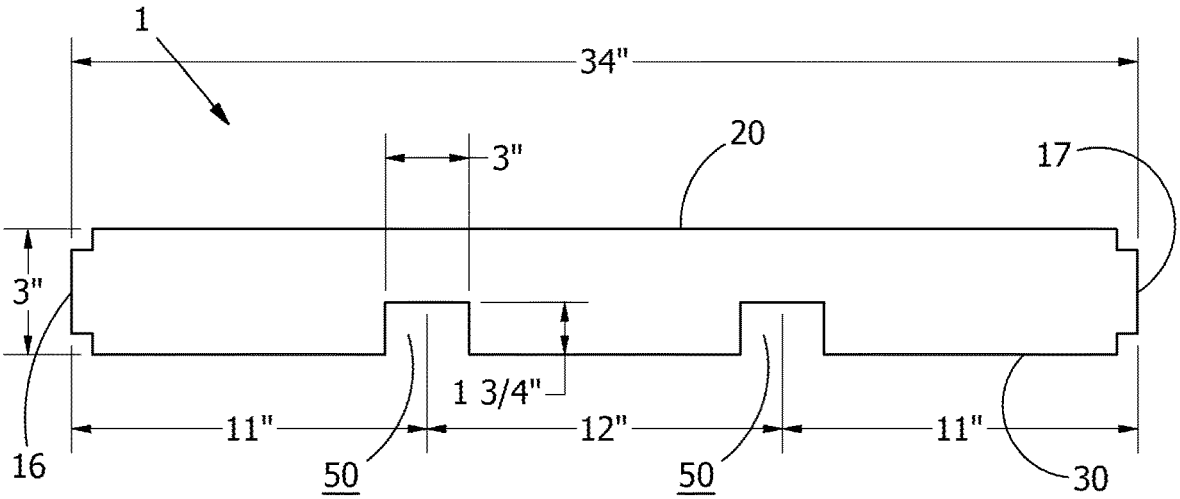
FIG. 4 is a side dimensional view showing dimensions of one embodiment of a toe board of the invention for use on commercial roofing.

FIG. 4 is a side dimensional view showing dimensions of one embodiment of a toe board of the invention for use on commercial roofing panels 112. The commercial vision of the toe board 1 is similar to the residential version of FIG. 3A-3C. However the size and spacing of the corrugation openings 50 are suited to the size and configuration of the corrugation ridges 112 of conventional commercial metal panels 1. In other to accommodate the corrugation ridge 112 of commercial panels, the corrugation openings are about 3 inches wide and 1.75 inches tall. Each corrugation opening 50 is centered about 11 inches from its respective end 16, 17. The corrugation openings 50 are centered about 12 inches apart.

As shown in FIGS. 5B-5D, the attachment members 60 are about 3 inches long and 2.75 inches wide. The opposing walls 62, 64 are about 3 inches long and 2.75 inches tall.

The foregoing dimensions are exemplary. Alternative dimensions can be used for all of the dimensions discussed herein, but the foregoing dimensions provide optimal sizing for portability, weight and strength.

Figure 6A:
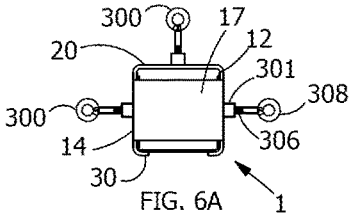
FIG. 6A is an end view of one embodiment of a toe board of the invention having tie down features for securing a ladder.
Figure 6B:
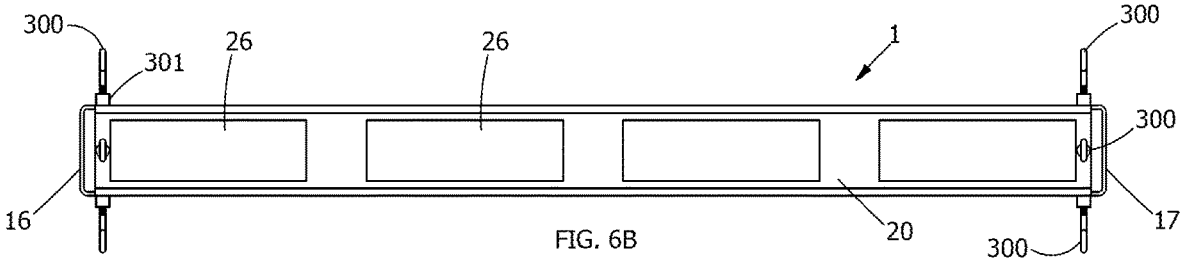
FIG. 6B is a top view of one embodiment of a toe board of the invention having tie-down features for securing a ladder.
Figure 6C:
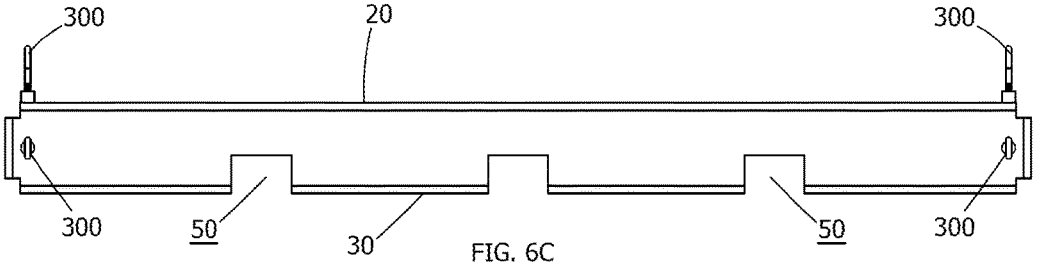
FIG. 6C is a side view of one embodiment of a toe board of the invention having tie-down features for securing a ladder.

For OSHA compliance, the toe board device 1 can serve as a ladder tie off point. In the embodiments shown in FIGS. 6A-6C, the toe board 1 includes a plurality of tie members 300 for use in tying a ladder 200 to the toe board 1. As seen in FIGS. 6A-6C, the tie member embodiment of a toe board 1 includes the various features described above. Additionally, a plurality of tie members 300 extend from a plurality of locations on the toe board 1. In the embodiment of FIGS. 6A-6C, six tie members 300 are provided. Three of the tie members 300 are disposed on or adjacent the first side wall 16, while the other three tie members 300 are disposed on or adjacent the second sidewall 17. As shown in the end view of FIG. 6A, a top tie member 300 is provided on the top surface 20, a front tie member 300 is provided on the front wall 12, and a back tie member 300 is provided on the back wall 14.

Details of one embodiment of the plurality of tie members 300 are shown in the end view of FIG. 6A. Each of the tie members 300 include an attachment base 301. The attachment base 301 is attached to the body of the tie board 1, such as by a weld or threaded connection. In the pictured embodiment, a threaded eye-bolt 305 is threaded into the attachment base 301. The threaded eye-bolt 305 is a conventional eye-bolt having an eye-portion 308 and a threaded shaft portion 306 extending therefrom. However, the tie members 300 could take various alternative forms, provided that the tie members 300 are firmly secured to the toe board 1 and include a structure suitable for tying a ladder to the tie member 300.

Figure 7:
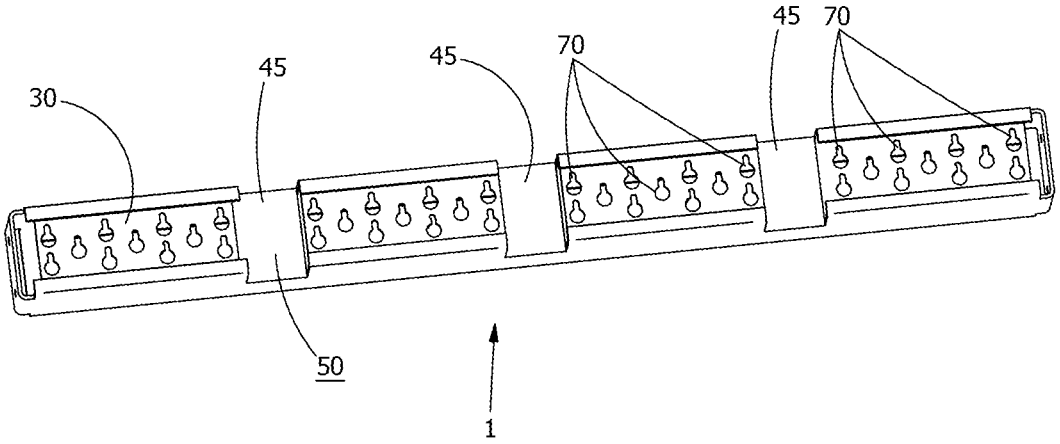
FIG. 7 is a side perspective view of one embodiment of a toe board of the invention featuring an alternative attachment arrangement.

While the foregoing embodiments are excellent for metal panel installation or use in inspection of older existing roofs, in some situations it may not be necessary to provide adjustable attachment members. FIG. 7 shows one embodiment of a toe board 1 of the invention that eliminates the slidable attachment members and replaces them with a plurality of attachment openings 70 formed through the solid bottom floor 30 of the toe board device 1. Unlike the prior embodiment, a large number of openings 70 are provided in order to enhance the options for placing new or existing screws into a sufficient number of holes 70 while securing the toe board in a substantially transverse orientation to the corrugations 112 of the metal panels 110. A plurality of corrugation openings 50 are provided as in the previously described embodiments, with the corrugation openings 50 breaking up the solid bottom floor 30 into sections. A bottom wall 45 is shown, although this feature could be eliminated from the embodiment of FIG. 7 since there is no need to form separate compartments for retaining attachment members 60.

In operation, the toe board 1 is used in the manner illustrated in FIG. 1. Generally, a roofer (not shown) places an initial panel 110 on the roof 100. The roofer typically installs panels from left to right along the length of the roof, as indicated in FIG. 1. The roofer temporarily secures the initial panel 110 to the roof in a desired location and orientation, then places a toe board 1 adjacent the bottom area of the panel. As indicated in FIG. 1, the toe board 1 is placed such that the corrugation openings 50 span the corrugations 112 of the panel 112 and such that the bottom floor 30 of the toe board 1 rests substantially flat on the uncorrugated/flat portions of the panel 110. The roofer positions the respective attachment members 60 at selected locations on the uncorrugated portions of the panels 110. The roofer inserts a roofing screw or other fastener into an attachment member opening 26. (Roofing screws conventionally are used with an associated washer, with the washer serving to prevent or minimize leaks around the screw hole; in the discussion of roofing screws herein, it will be assumed that the screws are provided with washers. "Screw" will also be interpreted to include alternative fasteners, although in current practice, screws are used almost exclusively in such operations.) The roofer inserts the screw into a slot portion 74 of a fastener opening 70. The roofer tightens the screw into the roof until the head of the screw secures the attachment member 60 against the panel 110. (Alternatively, in some situations the user will use screws that have already been placed in the metal panels, in a manner described in further detail below). This process is repeated with multiple screws until the toe board 1 is secured to the roof 100. The roofer then places a ladder 200 on the roof 100 such that the base 202 of the ladder 200 rests on the front support wall 12 while the legs 204 of the ladder 200 extend above the toe board 1 and rest on top of the roof 100 or panel 110.

With the ladder 200 secured in place, the roofer climbs along the ladder 200 while securing the panel 110 on the roof 100. Once the panel 110 is secured, the roofer places a second panel 110 adjacent to the first panel 110. The panels 110 are configured such that the edges of the first and second panels overlap at a corrugation, as indicated in FIG. 1. As indicated in FIG. 1, the toe board 1 is sized to fit over a single panel 110, and thus not interfere with the application and overlap of an adjacent panel 110. The roofer then repeats the foregoing process of placing a toe board 1 on the second panel 110, positioning the attachment members 60 and fastening the attachment members 60 to the roof 110 with screws or other fasteners. The steps are repeated, working across the roof 100 until the roof 100 is fully paneled.

In FIG. 1, the roofer has used a plurality of toe boards 1 to carry out the foregoing steps, working sequentially across the roof from right to left. It should be noted, however, that the foregoing can be accomplished by removing previously used toe board or toe boards 1 and moving the toe boards 1 to new locations. The design of the toe board 1 facilitates easy removal from the roof 100 simply by pulling up the screws or removing alternative fasteners. The use of multiple toe boards 1 promotes efficient application of panels, but a single toe board 1 can be used to accomplish the same result.

Use of the device for inspections is similar to the uses described above. However, when inspecting roofs, it is generally desirable to use existing roofing screws to attach the toe board 1 rather than apply new screws to the roof, since each screw hole is a potential source of leaks. The design of the toe board device 1 of the invention makes this particularly easy. The inspector simply partially loosens or untightens a row of existing screws by a selected amount sufficient to accommodate the thickness of the attachment members 60, places the toe board device 1 over the area of the partially loosened screws, adjusts the attachment members 60 such that some of the faster openings 70 contain loosened screws, and then retightens the loosened screws such that the screws secure the attachment members 60, and thus the toe board device 1, to the roof (It will be appreciated that the foregoing procedure of using existing screws can also be used when applying new metal panels to a roof, depending on the operation and the preferences of the roofer.)

As can be appreciated, the ability to slide the attachment members 60 within the device 1 facilitates the ability to use existing roofing screws in this operation. The configuration of the fastener openings 70, with a large portion 72 for accepting the screw along with an adjacent slot portion 74 for securing the screw head, further facilitates this operation. Additionally, the device 1 can be configured such that some degree of freedom is allowed to adjust the attachment member 60 toward the top or bottom walls; while the amount of freedom will typically be small, it assists in placing and securing the device 1 on existing roofing screws.

For OSHA compliance, the ladder 200 can be tied to the toe board 1 with ropes (not shown). If the embodiment of FIG. 6 is used, the ropes can be tied to the tie members 300.

For OSHA compliance, the toe board device 1 can serve as a safety step when a roofer is transitioning from the ladder 200 to the roof 100. When a roofer steps onto a metal panel, there is a danger of slipping. With the toe board device 1, this risk is eliminated.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A device for use in securing a ladder to a roof for use in attaching roofing panels to the roof or for inspecting panels, the panels having a planar surface interspersed with a plurality of corrugations, the device comprising:

a main body portion, the main body portion comprising a lengthwise box having a bottom floor, a top side, a back wall and a front wall, the front wall extending between the bottom floor and top side and configured to support a base of said ladder, the bottom floor having a plurality of corrugation openings formed therethrough, the corrugation openings sized and configured to straddle said corrugations of said panel while allowing the bottom floor to lie substantially flat on said panel, and a plurality of fastener openings functionally associated with the bottom floor for use in selectively securing and detaching the main body portion to said roof using roofing fasteners, each of the fastener openings having a larger portion for receiving a head of a fastener therethrough and a slot portion for retaining a head of a fastener, the top side having a plurality of attachment openings therethrough, each of the attachment openings providing access to the fastener openings for use in selectively attaching the main body portion to said roof with fasteners and for selectively detaching the main body portion from the roof by disengaging fasteners, a plurality of attachment member chambers formed in the main body portion, each of the attachment member chambers containing an attachment member slidably disposed within the attachment member chamber, the attachment member chambers positioned for removably securing the attachment members to said planar surface of said panel when the corrugation openings straddle said corrugations of said panel, each of the attachment members having a bottom base portion, the bottom base portion including a portion of the plurality of fastener openings formed therethrough, and each of the attachment openings associated with one of the attachment member chambers to thereby provide access to the attachment members, a front top rail and an opposing back top rail each extending into the attachment openings along the top side, and a front bottom rail and an opposing back bottom rail each extending into the main body portion along the bottom floor, the rails together configured to assist in retaining the attachment members in a sliding relationship inside of the main body portion.

2. The device of claim 1, wherein the bottom base portion of each of the attachment members includes at least six of the plurality of fastener openings.

3. The device of claim 2, wherein the plurality of attachment openings is four fastener openings.

4. The device of claim 2, wherein the plurality of attachment openings is three fastener openings.

5. The device of claim 1, wherein the main body portion is a unibody structure.

6. The device of claim 1, further comprising a plurality of tie members extending from the main body portion for use in tying said ladder to the main body portion.

7. The device of claim 1, wherein the device is sized and configured for use with standard residential panels.

8. The device of claim 7, wherein the main body portion is about 33 inches long and has three corrugation openings, the corrugation openings are about 2 inches wide and about 1.25 inches tall to thereby provide sufficient clearance for corrugations of standard residential metal panels, and the corrugation openings are centered about 7.5 inches apart to thereby allow the device to straddle corrugations of standard residential metal panels.

9. The device of claim 7, wherein the plurality of attachment openings is four fastener openings.

10. The device of claim 8, wherein the plurality of attachment openings is four fastener openings.

11. The device of claim 1, wherein the device is sized and configured for use with standard commercial panels.

12. The device of claim 11, wherein the main body portion is about 34 inches long and has two corrugation openings, the corrugation openings are about 3 inches wide and about 1.75 inches tall to thereby provide sufficient clearance for corrugations of standard commercial panels, and the corrugation openings are centered about 12 inches apart to thereby allow the device to straddle corrugations of standard commercial metal panels.

13. The device of claim 11, wherein the plurality of attachment openings is three fastener openings.

14. The device of claim 12, wherein the plurality of attachment openings is three fastener openings.

15. The device of claim 1, wherein the plurality of fastener openings includes at least six fastener openings positioned between each of said corrugation openings.

16. The device of claim 15, wherein the plurality of attachment openings is four fastener openings.

17. The device of claim 15, wherein the plurality of attachment openings is three fastener openings.

18. The device of claim 1, wherein the plurality of attachment openings is four fastener openings.

19. The device of claim 1, wherein the plurality of attachment openings is three fastener openings.

* * * * *